US008040654B2

(12) United States Patent
Lenz

(10) Patent No.: US 8,040,654 B2
(45) Date of Patent: Oct. 18, 2011

(54) RELAY CONTROLLER FOR CONTROLLING AN EXCITATION CURRENT OF A RELAY

(75) Inventor: Michael Lenz, Zorneding (DE)

(73) Assignee: Infineon Technologies AG, Neubiberg (DE)

( * ) Notice: Subject to any disclaimer, the term of this patent is extended or adjusted under 35 U.S.C. 154(b) by 114 days.

(21) Appl. No.: 12/465,678

(22) Filed: May 14, 2009

(65) Prior Publication Data

US 2009/0284889 A1 Nov. 19, 2009

(30) Foreign Application Priority Data

May 15, 2008 (DE) ..... 10 2008 023 626

(51) Int. Cl.
*H01H 47/00* (2006.01)

(52) U.S. Cl. ..... 361/160; 361/139

(58) Field of Classification Search ..... 361/139, 361/140, 160
See application file for complete search history.

(56) References Cited

U.S. PATENT DOCUMENTS 6,061,224 A * 5/2000 Allen ..... 361/154
2003/0209994 A1* 11/2003 Kerenyi, Jr. ..... 315/219
2004/0201945 A1* 10/2004 Dovheim ..... 361/160
2005/0047053 A1* 3/2005 Meyer et al. ..... 361/139

FOREIGN PATENT DOCUMENTS

| | | | |
|---|---|---|---|
| DE | 4325578 | A1 | 2/1995 |
| DE | 4410819 | C2 | 8/1996 |
| DE | 69702314 | T2 | 12/2000 |
| DE | 102004010914 | A1 | 9/2005 |
| DE | 69731438 | T2 | 11/2005 |
| EP | 1291256 | B1 | 9/2006 |

* cited by examiner

*Primary Examiner* — Danny Nguyen
(74) *Attorney, Agent, or Firm* — SpryIP, LLC

(57) ABSTRACT

The invention relates to a relay controller (500) for controlling an excitation current of a relay (300), wherein the relay controller (500) is designed, upon the energization of the relay (300) by means of a switch (210, 211, 221), to control the excitation current through the excitation winding (310) of the relay (300) in such a way that through the excitation winding (310) there flows firstly a pull-in current and, after a pull-in time has elapsed, through the excitation winding there flows a holding current that is lower than the pull-in current, and wherein the relay controller (500) is designed, upon the switching-off of the relay by means of the switch (210, 211, 221), to feed a commutation current that flows through the excitation winding (310) to the commutation device (400) through the first terminal (501) and through the second terminal (502) of the relay controller (500).

20 Claims, 5 Drawing Sheets

RELAY CONTROLLER FOR CONTROLLING AN EXCITATION CURRENT OF A RELAY

The present invention relates to a relay controller for driving an excitation winding of a relay, and a relay device for switching loads.

Figure 1:
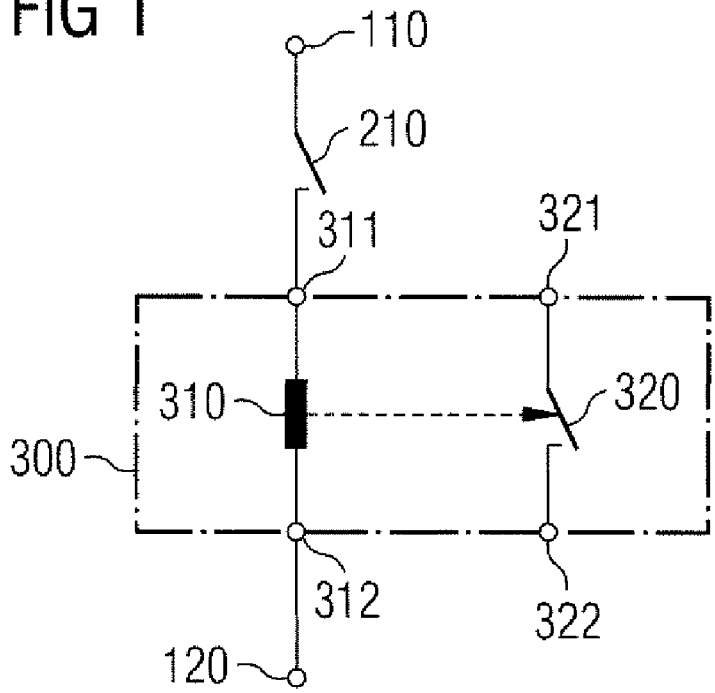

When relays are used, high-side or low-side switches that connect an excitation winding of the relay to the operating voltage are used. In this case, the term high-side or low-side identifies the position of the switch relative to the load, which in this case is the excitation winding of the relay. A high-side switch is connected by one terminal to a battery, and a low-side switch is connected by one terminal to a reference potential, usually earth. A relay with a high-side switch is illustrated in FIG. 1. The current through the excitation winding is limited by the coil resistance of the excitation winding for example in automotive applications. The disadvantages of such arrangements are the high current consumption after switch-on, the high costs of the excitation winding and the high inductance of the excitation winding. The high inductance of the excitation winding, which arises as a result of the many windings with a thin wire having a high impedance, makes it more difficult for commutation of the relay to be effected, and a slow drop-out of the relay operating contacts of the relay is the consequence. The slow drop-out of the secondary side of the relay can enable sparking to occur at the relay operating contacts of the relay. This sparking considerably impairs the service life of the relay.

A current-saving relay driving system reduces the current after the pull-in of the relay armature, that is to say shortly after switch-on, in order thus to reduce the power consumption of the switched-on relay. Such a circuit arrangement for the operation of a relay is disclosed in DE4410819. In DE4410819, a switch T1 bridges a holding resistor R4, which sets the holding current of the excitation winding of the relay. As a result of the bridging of the resistor R4, a higher pull-in current is available at the first moment of switching on the excitation winding.

Figure 3:
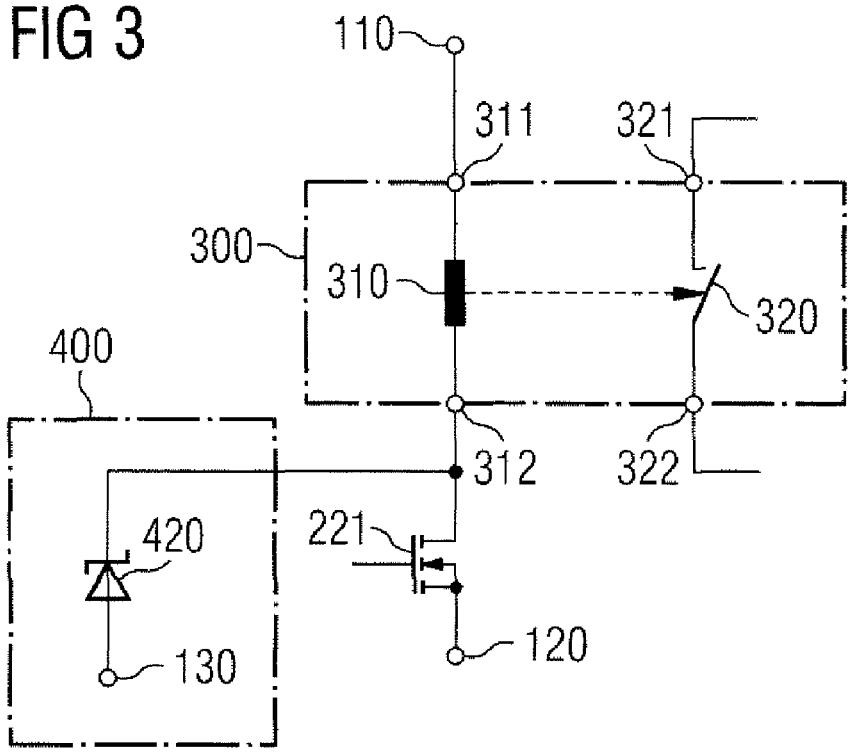

For commutation purposes, a commutation voltage has to be applied counter to the current direction via the excitation winding; the higher said commutation voltage, the more rapidly the energy of the excitation winding is reduced and the faster the commutation becomes. A diode reverse-connected across the excitation winding can be used for commutation purposes, such that the commutation current can flow through the then conducting diode, as is illustrated in FIG. 3. The diode has the disadvantage that a forward-biased diode permits only a low commutation voltage across the excitation winding, with the result that the commutation takes place slowly. As is illustrated in FIG. 3, a zener diode can also be used for commutation purposes, said zener diode being connected to the excitation winding of the relay in such a way that the commutation current can flow through the zener diode undergoing breakdown. A zener diode has the disadvantage of a very high power loss. Moreover, a high proportion of energy is drawn from the battery and converted in addition to the energy in the winding in the switch.

As illustrated in FIG. 3, a resistor can also be used for commutation purposes, such that the commutation current can flow through the resistor connected in parallel with the excitation coil. A resistor permits a high voltage on the excitation winding. The higher the voltage on the excitation winding is chosen to be, the more rapidly the excitation current decreases. The relay contacts open more rapidly in the case of a high commutation voltage at the excitation coil than in the case of a low commutation voltage. Rapid opening of the relay contacts reduces erosion of the relay contacts. A resistor has the disadvantage that a high voltage pulse arises shortly after turn-off, which pulse can only be controlled with expensive high-voltage semiconductor switches. A resistor has the further disadvantage that current flows through the resistor when a relay is switched on.

In automobiles, in particular, in which the petrol consumption is directly dependent on the current requirement of the electronics used, solutions which reduce the current consumption of the electronics and hence the $CO_2$ emissions of the automobile, are inexpensive to manufacture and have a long service life are becoming important.

The present invention is therefore based on the object of providing a relay controller and a relay device in which the excitation current of a relay is controlled in current-saving fashion in a simple manner.

This object is achieved by means of a relay controller comprising the features of claim 1 and by means of a relay device comprising the features of claim 16. The dependent claims define respectively preferred embodiments.

The relay controller for controlling an excitation current of a relay comprises a first terminal, which is connected to an excitation winding of the relay, a second terminal, which is connected to a commutation device of the relay, wherein the relay controller, when the relay is turned on, controls the excitation current through the excitation winding of the relay in such a way that through the excitation winding there flows firstly a pull-in current and, after a pull-in time has elapsed, through the excitation winding there flows a holding current that is lower than the pull-in current, and wherein the relay controller, when the relay is switched off, feeds a commutation current that flows through the excitation winding to the commutation device through the first terminal and through the second terminal of the relay controller.

The relay controller preferably lies in the freewheeling path of the relay. The relay controller controls the temporal sequence of the pull-in operation of the relay. If the high-side switch or the low-side switch turns the relay circuit off, the relay controller conducts the freewheeling current or the commutation current to the commutation device. The voltages at the terminals of the relay controller remain limited to low values. By contrast, the switch-side terminal of the excitation winding can oscillate freely, its voltage swing preferably being limited by the breakdown voltage of the switch. It is also possible to use mechanical or other inexpensive switches.

The relay controller can be designed to control the excitation current only after a current that flows, after the switching-on of the switch, through the commutation device into the second terminal energizes the relay controller. For this purpose, the commutation device has to enable the flow of the current switched by the switch to the relay controller. For this purpose, by way of example, the commutation device can be embodied as a resistor. After the switch has been switched on, current firstly flows via the commutation device through the second terminal into the relay controller and thereby starts the latter. At this moment no excitation current can be provided by the relay controller. Once the relay controller is ready for operation, the excitation current can also be provided.

The relay controller can be designed to detect the current that flows after the energization of the relay through the switch, through the commutation device into the second terminal, in order thus to determine a turn-on instant, wherein this turn-on instant determines the start of the pull-in time. This state can be detected for example by a power-on reset circuit that monitors the internal supply voltage. A power-on reset circuit monitors an internal supply voltage and generates a signal as soon as the internal supply voltage exceeds a specific threshold. After the detection, a capacitor or a counting device can be reset. The start of the relay controller then determines the start of the pull-in time.

The relay controller can be designed to detect the excitation current. If the excitation current exceeds a threshold, the capacitor or the counting device can be reset. The exceeding of the excitation current threshold then determines the start of the pull-in time.

The device can comprise a temperature sensor circuit comprising a temperature sensor for detecting the temperature of the relay controller. The temperature sensor circuit can be designed to implement measures for reducing the power consumption of the relay controller if a maximum temperature is exceeded. One measure for reducing the power consumption of the relay controller can consist in turning off the current through the excitation winding.

In one embodiment, the relay controller draws a current from the second terminal during operation. The relay controller thus utilizes the current flowing through the commutation device for its own supply, with the result that there is no need for a further terminal for providing a supply voltage. The current that flows through the commutation device is limited by the relay controller since only the current required for supplying the relay controller flows.

The relay controller can have a third terminal, which is connected to the second reference potential, for example earth. The voltage between the first terminal and the third terminal can be limited by means of a voltage limiting device. The relay controller can thus limit the voltage upon reduction of the current after the pull-in of the armature. If the relay controller is jeopardized by an increased temperature, for example, the voltage limiting device protects the relay controller against high voltages.

The third terminal can preferably be connected to the reference potential. An internal supply voltage can be established between the second terminal and the third terminal. Between the first terminal and the third terminal, the relay controller can comprise a current source and a second switch for providing an excitation current.

Between the first terminal and the second terminal, the relay controller can have a first switch for controlling the commutation current.

The first switch of the relay controller can be a diode. In one embodiment, the cathode of the diode of the first switch is connected to the second terminal of the relay controller. The first switch of the relay controller can be a MOS transistor or a bipolar transistor.

The relay controller can have an undervoltage sensor between the second terminal and the third terminal, for detecting an undervoltage.

If the undervoltage sensor detects an undervoltage, the relay controller can reset the pull-in time to a predetermined value. The relay controller can thus indirectly change over to a higher current, or to a maximum possible current, in order that the relay operating contacts remain closed even when there is a low voltage between the first and the second reference potential.

The relay controller can comprise a second switch provided in parallel with the current source that provides excitation current, said second switch bridging the current source if the undervoltage sensor detects an undervoltage. The relay controller thus provides a maximum possible current in order that the relay operating contacts remain closed even in the case of a low voltage.

In a further exemplary embodiment, the current source provides only the holding current, and for the pull-in of the relay, the second switch bridges the current source during the pull-in time.

The relay controller can have a fourth terminal, wherein the pull-in time can be determined by means of a circuit connected to the fourth terminal.

A relay device for switching loads comprises: a relay, a relay controller comprising at least two terminals for controlling the relay, a commutation device, wherein the commutation device is coupled in parallel with the excitation winding of the relay via a first terminal and a second terminal of the relay controller, a switch, wherein the excitation winding of the relay, the relay controller and the switch are coupled in series.

In a relay device for switching loads, the relay controller can be integrated with the relay in a housing. The integration of the relay controller into the relay has the advantage that for example the handling and stockkeeping can be greatly simplified. In the case of integration, the relay controller can be coordinated precisely with the relay, with the result that a simplification of the relay controller can be afforded.

In a relay device for switching loads, the switch can be a high-side switch.

In a relay device for switching loads, the switch can be a low-side switch.

In a relay device for switching loads, the commutation device can contain at least one resistor.

In a relay device for switching loads, the commutation device can contain at least one zener diode.

Figure 2:
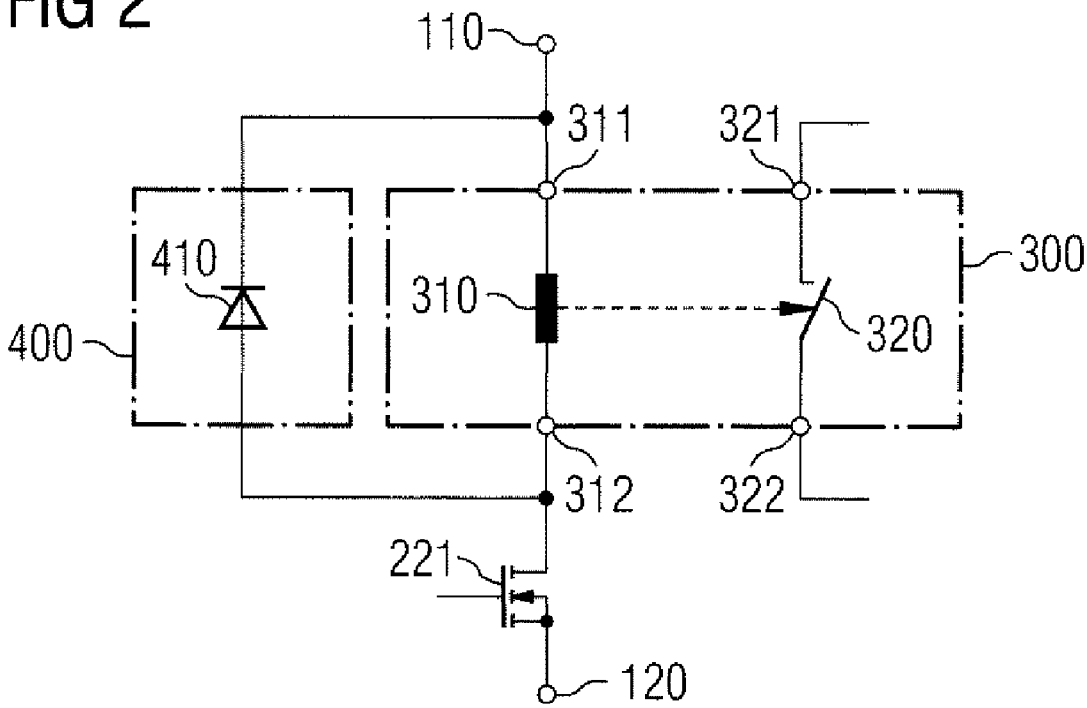
Figure 4:
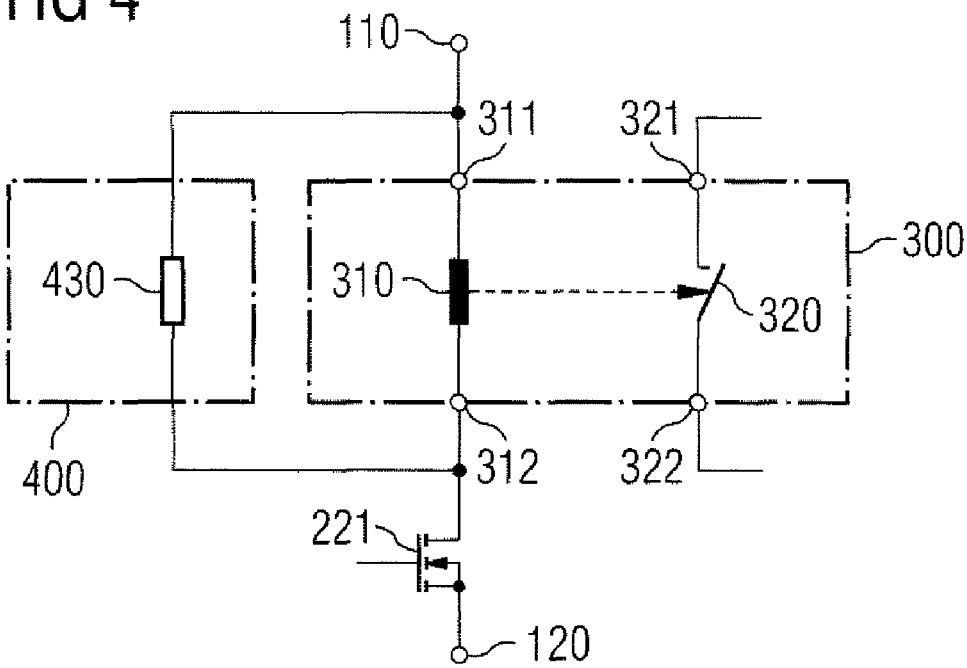
Figure 5:
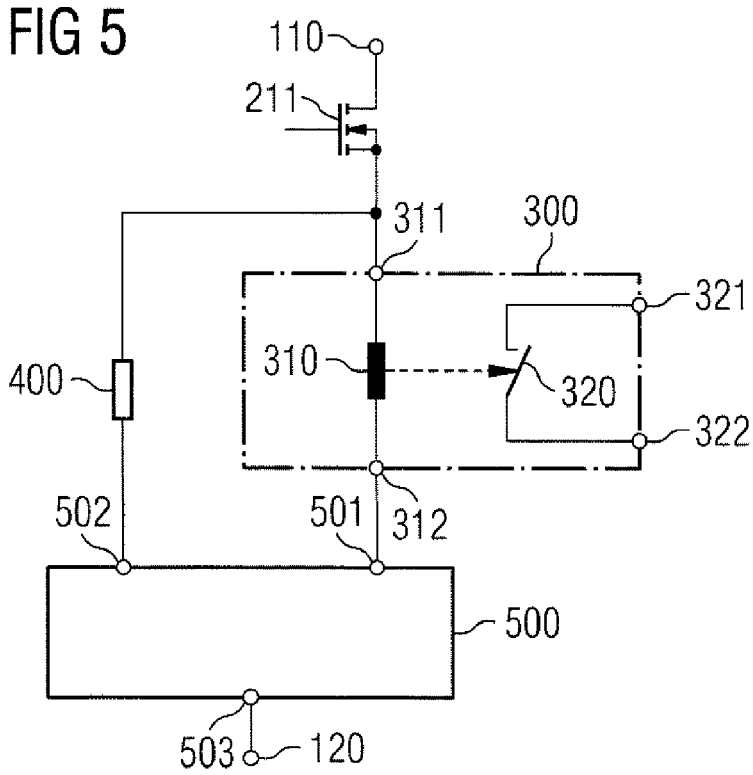
Figure 6:
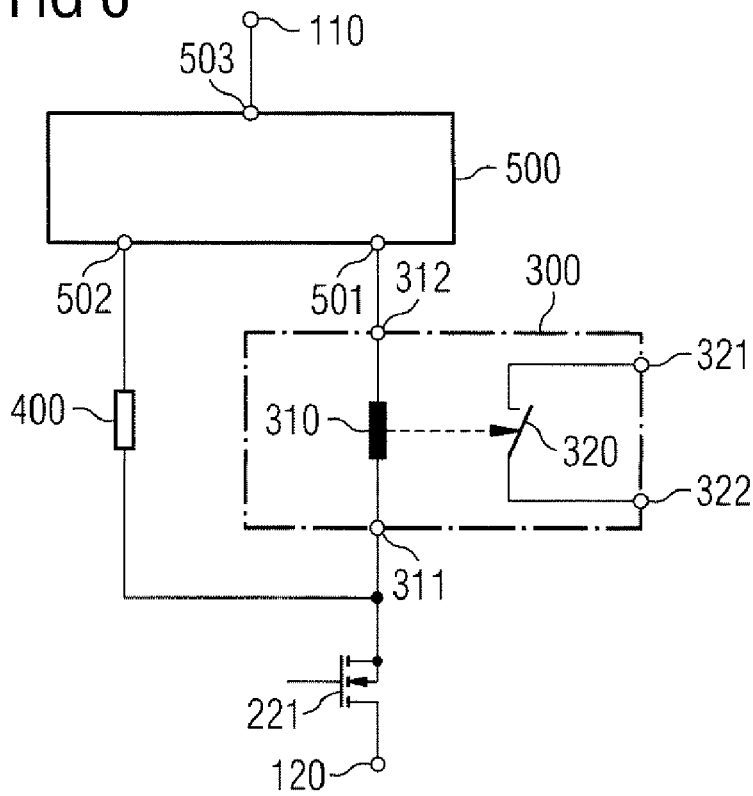
Figure 7:
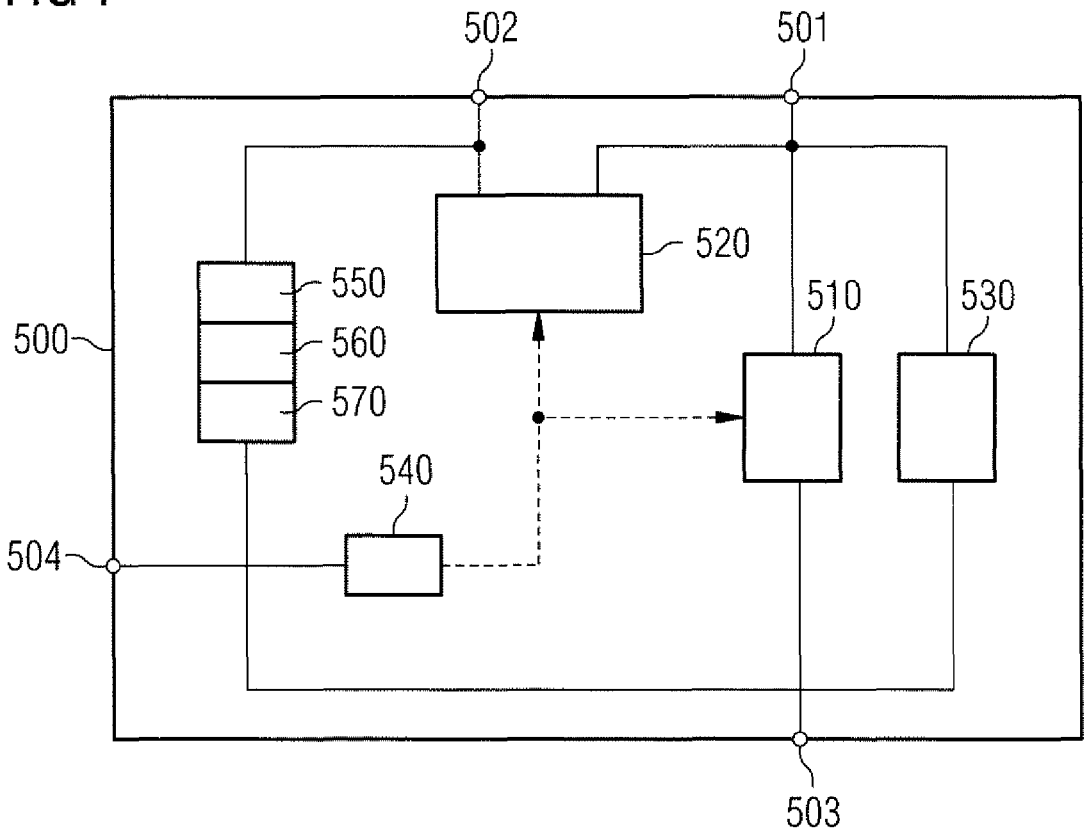

Embodiments are explained in more detail below with reference to the following drawings, in which FIG. 1 shows a relay with a high-side switch, FIG. 2 shows a relay with a low-side switch and a freewheeling diode, FIG. 3 shows a relay with a low-side switch and a zener diode, FIG. 4 shows a relay with a low-side switch and a resistor, FIG. 5 shows a relay with a high-side switch, a commutation circuit and a relay controller, FIG. 6 shows a relay with a low-side switch, a commutation circuit and a relay controller, FIG. 7 shows a relay controller, and FIG. 8 shows signal profiles.

FIG. 1 shows a relay 300 and a high-side switch 210, which are connected in series between the reference potentials 110 and 120 in a known manner. The voltage between the reference potentials 110 and 120, the supply voltage Vs, can be a battery voltage for example in an automobile. The high-side switch 210 or the low-side switch switches the supply voltage onto the excitation winding 310 of the relay 300. The current through the excitation winding 310 can be limited by the coil resistance of the excitation winding 310.

FIGS. 2 to 4 show different known embodiments of a commutation device. The commutation devices 410, 420, 430 shown can also be employed with high-side switches. In FIG. 2, the commutation device 400 is embodied as a diode 410. If the low-side switch, here embodied as an NMOS transistor 221, is switched on, an excitation current flows through the excitation winding 310. On account of the inductive properties of the excitation coil, the excitation current continues to flow until the energy stored in the excitation winding has been dissipated. After the NMOS transistor 221 has been turned off, the excitation current flows through a freewheeling path or through the commutation device 400, which is configured in such a way that the energy of the excitation winding is dissipated. After the NMOS transistor 221 has been turned off, the excitation current flows through the now conducting diode. The potential of the second terminal of the excitation winding is approximately 0.7 to 1.3 volts above the first reference potential 110. On account of the low diode voltage across the excitation winding, the energy of the excitation winding is dissipated only slowly, with the result that the commutation operation lasts a long time and the opening of the relay operating contacts lasts a long time, whereby much erosion can be produced at the relay operating contacts. Faster opening of the relay contacts can be achieved by means of commutation devices that permit a higher voltage on the excitation winding. Embodiments of such commutation devices are shown in FIG. 3 and FIG. 4. The zener diode 420 from FIG. 3 permits higher voltage on the excitation winding 310, such that the energy of the excitation winding 310 can be rapidly dissipated and, as a consequence of this, the relay operating contacts open rapidly. A further advantage of the zener diode 420 is that it can easily be integrated into the NMOS transistor. During the commutation, current can still be drawn from the supply voltage Vs, this current leading to additional losses.

A resistor 430 as commutation device 400 in accordance with FIG. 4 has the advantages that during commutation no commutation current is drawn from the supply voltage Vs, and that it permits a high voltage for the commutation of the excitation winding 310. The dimensioning of the resistor 430 is costly, however, since the voltage for commutation must not damage the NMOS transistor. Since the price of NMOS transistors increases with the ability of the transistors to withstand high voltages, an economic limit is placed on the dimensioning of the resistor 430. The additional current that flows via the resistor when the relay is turned on is likewise disadvantageous.

FIG. 5 shows an arrangement comprising a relay 300, a commutation device 400, an NMOS transistor 211 as high-side switch and a relay controller 500. A first terminal of the NMOS transistor 211 is connected to the first reference potential 110 and a second terminal of the NMOS transistor 211 is connected to the first terminal 311 of the excitation winding 310 of the relay 300 and to a first terminal of the commutation device 400. The second terminal 312 of the excitation winding 310 is connected to the first terminal 501 of the relay controller 500. A second terminal of the commutation device 400 is connected to the second terminal 502 of the relay controller 500. The third terminal 503 of the relay controller 500 is connected to the second reference potential 120. If this arrangement is used in an automobile, then the first reference potential 110 can be provided by the battery and the second reference potential 120 can be provided by the earth terminal of the automobile. The NMOS transistor 211 is only one exemplary embodiment of a high-side switch 210; the high-side switch 210 can also be embodied as a PMOS transistor, PNP or NPN transistor, or as a relay operating contact of a relay. The high-side switch 210 can also be connected to a plurality of arrangements comprising relay 300 and relay controller 500.

An arrangement comprising a low-side switch is possible analogously to this and is shown in FIG. 6. In such an arrangement, the third terminal 503 of the relay controller 500 is connected to the first reference potential 110, thus resulting in an arrangement which arises from the mirroring of the high-side arrangement about a horizontal axis. The description of the function of a relay 300 with a relay controller 500 with a high-side switch 210, 211 is analogously also applicable to the arrangement comprising a low-side switch.

If the high-side switch 211 is switched off, the entire arrangement is without current and the relay is switched off. In other words, the switch 320 of the relay 300 is open, with the result that no current can flow through the terminals 321, 322 of the relay 300. This state corresponds, in FIG. 8, to the states before the instant t1 is reached.

Figure 8A:
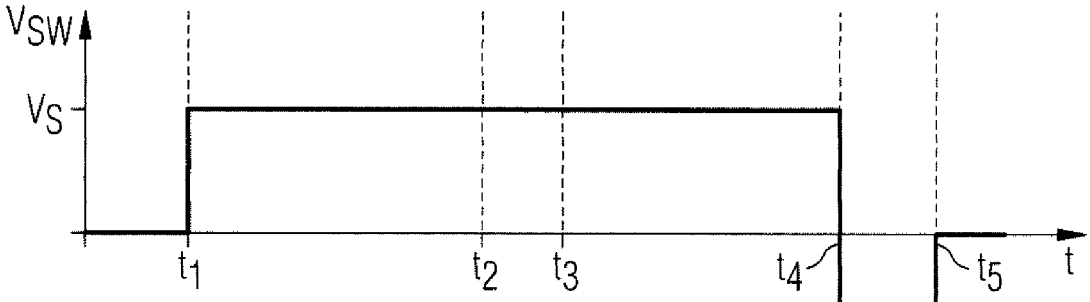

FIG. 8*a* shows a switching voltage Vsw between the terminal of the excitation winding 311 and the third terminal 503 of the relay controller.

Figure 8B:
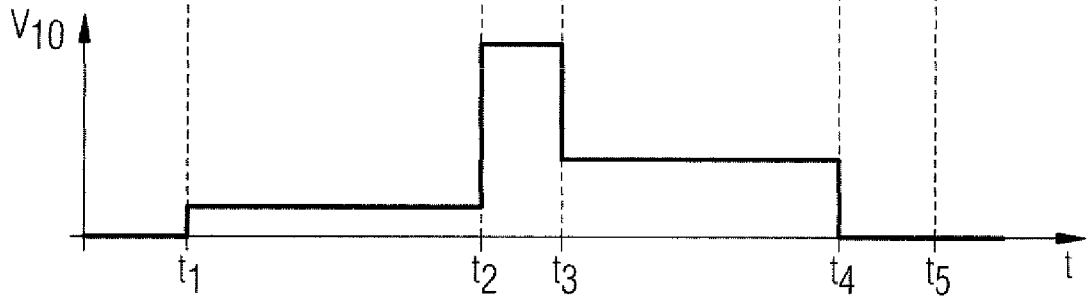

FIG. 8*b* shows an output voltage Vro between the first terminal 501 of the relay controller 500 and the third terminal 503 of the relay controller.

Figure 8C:
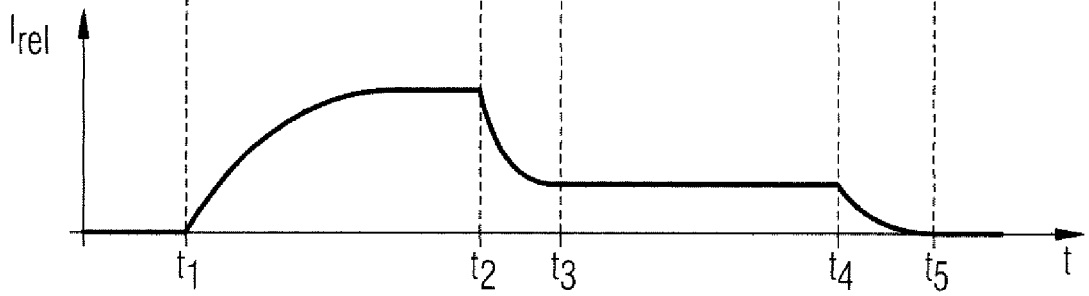

FIG. 8*c* shows an excitation current Irel that flows into the terminal 311 of the excitation winding through the excitation winding 310.

Figure 8D:
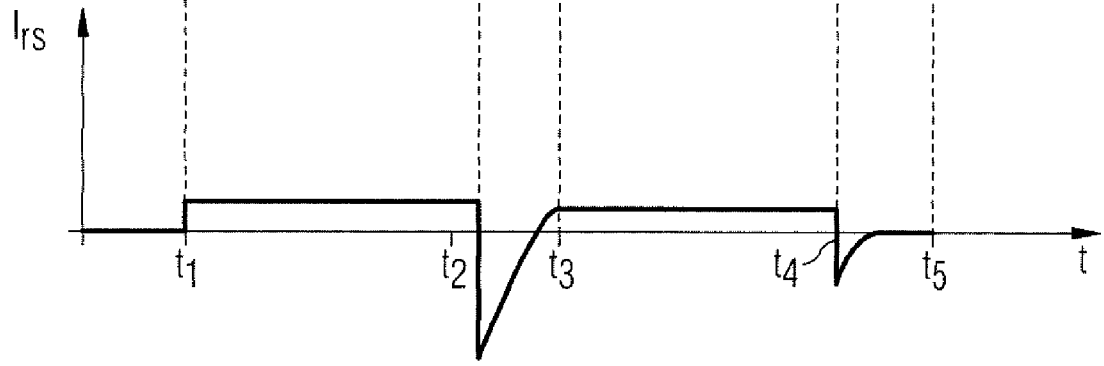

FIG. 8*d* shows a supply current Irs of the relay controller that flows into the second terminal 502 of the relay controller 500.

The instants t1 to t5 in FIG. 8 describe instants at which the state of the arrangement changes, the high-side switch 210, 211 being switched off until t1. If the high-side switch 210, 211 is closed at the instant t1, then the switching voltage Vsw rises almost to a supply voltage Vs. The supply voltage Vs is the voltage between the first 110 and the second 120 reference potentials. Assuming that the internal resistance of the high-side switch 210, 211 is low, the voltage drop across the high-side switch 210, 211 can be disregarded. A supply current Irs then flows into the relay controller 500 via the commutation device 400. With the aid of the supply current, the relay controller 500 starts and, with the aid of a switch or a current source, provides the excitation current Irel at the first terminal 501 of the relay controller 500.

After the relay controller 500 has started, the start instant of the pull-in time can be determined and defined. The excitation current Irel rises continuously, and the relay operating contact 320 of the relay 300 closes before the excitation current Irel has reached the magnitude of the predetermined pull-in current of the relay 300. The output voltage Vro remains for as long at a low level which can correspond to a minimum drain voltage of a MOS transistor or a minimum collector voltage of a bipolar transistor.

In addition to a current source that can be embodied as a current source transistor, a second switch that can be embodied as a switching transistor is also possible in order to minimize the output voltage further. The excitation current can be detected, in which case the exceeding of a threshold can determine a start instant of the pull-in time. If the predetermined pull-in current has been reached, the excitation current Irel rises further until it is limited by the sum of the resistances if the pull-in current is provided by a switch. If the pull-in current is provided by a current source, the excitation current Irel does not rise further.

The output voltage Vro settles to a value given by the supply voltage Vs, the pull-in current and the internal resistance of the excitation winding 310. Independently of this, the potential at the second terminal 502 of the relay controller 500 assumes a value given by the internal resistance of the commutation device 400, the supply voltage Vs and the supply current Irs.

At the instant t2, after the pull-in time has elapsed, the relay controller 500 switches the excitation current from the value of the pull-in current to a predetermined value of a holding current. The holding current can be chosen such that it is lower than the pull-in current, but high enough that the relay operating contact 320 of the relay 300 remains closed.

The instant t2 can be determined by a predetermined pull-in time. The instant t2 can also be determined by the relay controller 500 detecting the instant at which the excitation current has reached the value of the pull-in current and permitting a predetermined pull-in time to elapse after this instant.

The energy difference arising from the difference of the pull-in current and of the holding current of the excitation current can be dissipated via the commutation device 400 by the excess excitation current being conducted through the first 501 to the second 502 terminal of the relay controller 500 to the commutation device 400. A current resulting from the difference of the supply current Irs and of the excess excitation current then flows from the second terminal 502 of the relay controller 500. While the excitation current decreases, a voltage that can be higher than the supply voltage Vs is established by the commutation device at the first terminal 501 and second terminal 502 of the relay controller 500. This voltage can be limited by a voltage limiting circuit, which can be within or outside the relay controller 500 and can be e.g. a zener diode.

Once the energy difference arising from the difference of the pull-in current and of the holding current of the excitation current has been dissipated, the instant t3 has been reached. The output voltage Vro settles to a value given by the supply voltage Vs, the holding current and the internal resistance of the excitation winding 310.

Depending on the magnitude of the supply voltage Vs, conditions in which the relay controller 500 cannot provide a sufficient excitation current can arise in this or a preceding state. An undervoltage sensor circuit 570 detects if the supply voltage is too low to provide a sufficient excitation current, and initiates measures for increasing the excitation current. One measure is to bridge the current source by means of a switch having a low voltage drop.

Depending on the magnitude of the supply voltage Vs, conditions in which the power consumption of the relay controller 500 exceeds the permissible power consumption can arise in this or a preceding state. An increased power consumption can occur in the current source that provides the excitation current. The relay controller 500 can have a temperature sensor circuit 560 that initiates measures for reducing the power consumption of the relay controller 500 if a maximum temperature is reached. One measure is to reduce the excitation current. If this measure is unsuccessful, the excitation current can be completely turned off.

The relay is switched off by the high-side switch 210, 211 being switched off. In FIG. 8, the high-side switch is switched off at the instant t4. Since no excitation current can flow through the high-side switch 210, 211, the excitation current flows through the commutation device 400. As a result of the voltage drop thus caused across the commutation device 400, the switching voltage Vsw becomes negative. The negative switching voltage Vsw can be limited by a zener diode of the high-side switch 210, 211. In the case of mechanical switches, the voltage can remain unlimited. The voltage then reaches the value resulting from the product of the commutation resistance and the commutation current. Once the energy of the excitation coil 310 has been dissipated, the instant t5 has been reached in that the device is deenergized.

FIG. 7 shows an exemplary embodiment of a relay controller 500. A current controller 510 is connected to the first terminal 501 and the third terminal 503 of the relay controller 500. A voltage limiting circuit 530 is connected to the first terminal 501 and the third terminal 503 of the relay controller 500. A freewheeling controller 520 is connected to the first 501 and the second 502 terminal of the relay controller 500. A circuit for generating a supply voltage 550, a temperature sensor circuit 560 and an undervoltage sensor circuit 570 are connected to the second 502 and the third 503 terminal of the relay controller. A time controller 540 is designed to control the current controller 510. A fourth terminal 504 of the relay controller 500 can be formed, at which means for influencing the time controller 540 can be provided. One means for influencing a time controller 540 is a capacitor connected to the fourth terminal 504 of the relay controller 500. One exemplary embodiment of a current controller 510 contains an NMOS transistor or an NPN transistor, the drain or collector of which is connected to the first terminal 501 of the relay controller 500 and which is controlled in such a way that it provides a constant current. The current controller 510 can also contain an NMOS transistor or an NPN transistor, the drain or collector of which is connected to the first terminal 501 of the relay controller 500 and which is switched in such a way that the output voltage Vro becomes as low as possible. One exemplary embodiment of a voltage limiting circuit 530 contains a zener diode, the cathode of which is connected to the first terminal 501 of the relay controller. The voltage-limiting effect of the zener diode can be amplified by a circuit. One exemplary embodiment of a freewheeling controller 520 can contain a diode, the cathode of which is connected to the second terminal 502 of the relay circuit. Instead of a diode, the freewheeling circuit 520 can contain a transistor.

The invention claimed is:

1. Relay controller for controlling an excitation current of a relay, comprising:

a first terminal for connection to an excitation winding of the relay, a second terminal, for connection to a commutation device of the relay, wherein the relay controller is designed, upon the energization of the relay by means of a switch, to control the excitation current through the excitation winding of the relay in such a way that through the excitation winding there flows firstly a pull-in current and, after a pull-in time has elapsed, there flows a holding current that is lower than the pull-in current, and wherein the relay controller (500) is designed, upon the switching-off of the relay by means of the switch, to feed a commutation current that flows through the excitation winding to the commutation device through the first terminal and through the second terminal of the relay controller, and wherein for the operation of the relay controller a current is drawn from the second terminal.

2. Relay controller according to claim 1, wherein the relay controller is designed to detect the current that flows, after the switch has been switched on, through the switch and the commutation device into the second terminal, in order thereby to determine a turn-on instant and to start the elapsing of the pull-in time.

3. Relay controller according to claim 1, wherein the relay controller is designed to detect the excitation current and to start the elapsing of the pull-in time when a threshold is exceeded.

4. Relay controller according to claim 1, wherein the relay controller is designed to control the excitation current only after the current that flows, after the switch has been switched on, through the switch and through the commutation device into the second terminal energizes the relay controller.

5. Relay controller according to any of the preceding claims, comprising a temperature sensor circuit comprising a temperature sensor for detecting the temperature of the relay controller.

6. Relay controller according to claim 5, wherein the temperature sensor circuit is designed to implement measures for reducing the power consumption of the relay controller if a maximum temperature is exceeded.

7. Relay controller according to any of the preceding claims, wherein there is a first switch between the first terminal and the second terminal of the relay controller.

8. Relay controller according to claim 7, wherein the first switch is a diode.

9. Relay controller according to any of the preceding claims, comprising a third terminal and comprising a voltage limiting circuit which limits the voltage between the first terminal and the third terminal.

10. Relay controller according to any of the preceding claims, comprising an undervoltage sensor circuit for detecting an undervoltage between the second terminal and the third terminal of the relay controller.

11. Relay controller according to claim 10, wherein the undervoltage sensor circuit resets the pull-in time to a predetermined value, such that the pull-in current flows if a voltage is undershot.

12. Relay controller according to any of the preceding claims, comprising a current source and a second switch, wherein the current source is designed to provide the holding, current and the second switch is designed to provide the pull-in current.

13. Relay controller according to claim 11, comprising a current source that is designed to provide the pull-in current and the holding current, and comprising a second switch, in parallel with the current source, which bridges the current source if the undervoltage sensor circuit detects an undervoltage.

14. Relay controller according to any of the preceding claims, comprising a fourth terminal, comprising a circuit which is connected to the fourth terminal and which provides the pull-in time with a means connected to the fourth terminal.

15. Relay device for switching loads, comprising:

a relay, a relay controller for controlling the relay, comprising at least a first terminal and a second terminal, a commutation device, wherein the commutation device is coupled in parallel with the excitation winding of the relay via the first terminal and the second terminal of the relay controller, a switch, wherein the excitation winding of the relay, the relay controller and the switch are coupled in series, and wherein for the operation of the relay controller a current is drawn from the second terminal.

16. Relay device for switching loads according to claim 14, wherein the relay controller is integrated with the relay in a housing.

17. Relay device for switching loads according to either of claims 14 and 15, wherein the switch is a high-side switch.

18. Relay device for switching loads according to either of claims 14 and 15, wherein the switch is a low-side switch.

19. Relay device for switching loads according to any of claims 14 to 18, wherein the commutation device contains at least one resistor.

20. Relay device for switching loads according to any of claims 14 to 18, wherein the commutation device contains at least one zener diode.

* * * * *